United States Patent [19]

Grappe et al.

[11] Patent Number: 4,588,247

[45] Date of Patent: May 13, 1986

[54] ELECTRIC CONNECTORS INTENDED PARTICULARLY TO BE USED IN A LIQUID MEDIUM PARTICULARLY UNDER PRESSURE

[75] Inventors: René Grappe, Paris; Pascal Martin, Le Pre Saint Gervais, both of France

[73] Assignee: Souriau & C., Billancourt, France

[21] Appl. No.: 576,371

[22] PCT Filed: May 19, 1983

[86] PCT No.: PCT/FR83/00098

§ 371 Date: Jan. 19, 1984

§ 102(e) Date: Jan. 19, 1984

[30] Foreign Application Priority Data

May 19, 1982 [FR] France ..... 82 08831

[51] Int. Cl.[4] ..... H01R 13/62

[52] U.S. Cl. ..... 339/94 M; 339/117 P; 339/126 RS; 339/255 R

[58] Field of Search ..... 339/89 R, 89 C, 89 M, 339/94 R, 94 M, 60, 117 R, 117 P, 42, 255 R

[56] References Cited

U.S. PATENT DOCUMENTS

| | | | |
|---|---|---|---|
| 3,605,069 | 9/1971 | Dorrell | 339/94 M |
| 4,073,562 | 2/1978 | Karlskind | 339/117 P |
| 4,094,567 | 6/1978 | Karcher et al. | 339/42 |
| 4,188,084 | 2/1980 | Buresi et al. | 339/117 R |
| 4,488,765 | 12/1984 | Erbe | 339/42 |

FOREIGN PATENT DOCUMENTS

| | | | |
|---|---|---|---|
| 990820 | 6/1976 | Canada | 339/117 R |
| 7347120 | 7/1975 | France | 339/117 R |

*Primary Examiner*—Z. R. Bilinsky
*Assistant Examiner*—David L. Pirlot
*Attorney, Agent, or Firm*—Larson and Taylor

[57] ABSTRACT

The invention relates to improvements to electric connectors particularly intended to be used in a liquid medium. Both elements (A,B) of the connector comprise respectively insulating bodies (8,20) carrying the contacts (9,21) and surrounded, in their front parts, by sleeves (14,24); two ring seals (25,26) are brought on those sleeves on either side of the interface (15,22) of the two insulating bodies and insulate said insulating bodies from the surrounding liquid.

5 Claims, 2 Drawing Figures

Figure 1:
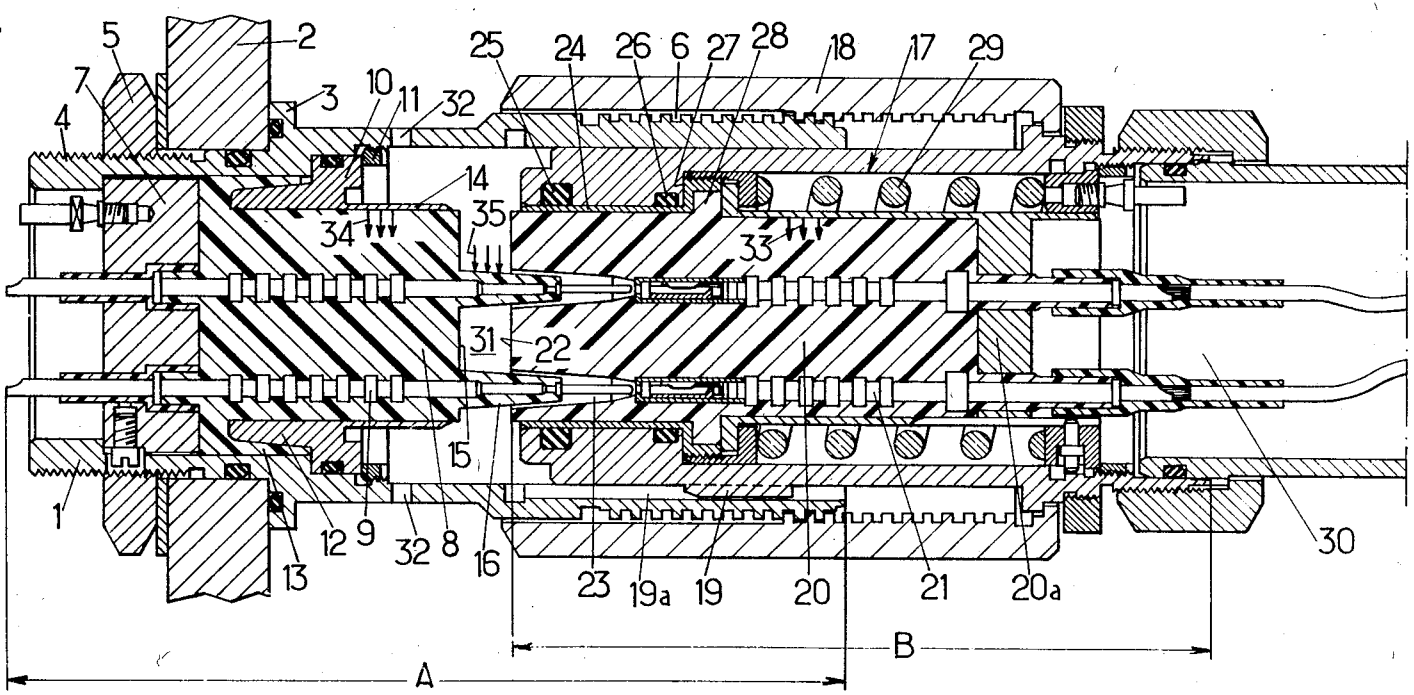

ELECTRIC CONNECTORS INTENDED PARTICULARLY TO BE USED IN A LIQUID MEDIUM PARTICULARLY UNDER PRESSURE

The present invention relates to improvements to electric connectors, intended particularly to be used in a liquid medium, formed from two connector elements removably coupable within the liquid medium and having respective electric contacts, the connector elements comprising respectively a cylindrical case supporting therein an insulating body which encloses said contacts.

The insulating body disposed inside the cylindrical case of each connector element is generally made from a relatively resilient synthetic material, such as an elastomer, which is electrically insulating: this insulating body is then adapted for mechanically supporting the electric contacts of said connector element while providing mutual electrical insulation of these contacts.

Now, the elastomers usually used for the application envisaged are rapidly damaged when they are held in contact with liquids, and particularly with sea water; the result is an impairment of the resistivity of the insulating body and a reduction of the between contact insulation resulting in electric leaks.

The invention has then essentially as its aim to remedy this disadvantage and to provide an electric connector which satisfies better than in the past the different requirements of practice, in particular in so far as its use in a liquid medium is concerned more especially in an under sea medium.

To this end, it is provided in accordance with the invention that, in an electric connector of the above mentioned kind, a rigid cylindrical sleeve surrounds at least the front part of each insulated body, that the two sleeves belonging respectively to the two connector elements have substantially the same transverse dimensions, more especially the same diameter, and are positioned axially on the respective insulating bodies so that, in the connection position of the two connector elements, they are substantially end to end, that insulating means are provided so that the mutual electric insulation of the contacts is provided during connection of the two connector elements, and that one of the connector elements (first connector element) has a ring external to the corresponding sleeve and axially movable, under the action of control means, towards the other connector element (second connector element) during the operation for coupling the two connector elements together, this ring being provided in its inner face with two annular seals spaced apart axially from each other by a distance such that, and the axial travel of the ring being such that, when the connector elements are not coupled together and when the ring is retracted into the first connector element, the annular seals bear on the corresponding sleeve whereas, when the two connector elements are coupled together and when the ring is in the projecting position, said ring then surrounds a front axial portion of the sleeve of the second connector element and the two annular seals bear respectively against the two rigid sleeves.

Thus, when the two connector elements are coupled together, the two annular seals sealingly surround the two rigid sleeves while being situated on each side of the cooperating front faces of the two connector elements. Thus, these seals provide sealing insulation of these cooperating front faces (faces whch are formed essentially by the front faces of the respective insulating bodies of the two connector elements) with respect to the remaining parts of the connector, which are in general bathed in the surrounding liquid medium. In other words, these seals prevent the insulating bodies from being in permanent contact with the surrounding liquid when the two connector elements are coupled to one another and they contribute to maintaining the electrically insulating properties of said bodies.

It is more particularly advantageous to associate with the preceding arrangements, complementary arrangements consisting in said insulating means comprising, in one of the connector elements, truncated cone shaped bosses provided on the front face of the insulating body and at the front end of which appear respectively the front ends of the corresponding contacts and, in the other connector element, truncated cone shaped recesses formed in the front face of the insulating body and at the bottom of which appear respectively the front ends of the corresponding contacts, the bosses and the recesses having respectively complementary shapes such that, in the coupling position of the two connector elements, the recesses sealingly surround the bosses.

Thus, when coupling of the two connector elements takes place within a liquid medium, contacting then maintenance in abutment of the front faces of the two insulating bodies having respectively truncated cone shaped bosses and truncated cone shaped recesses ensure that the liquid is driven from between the cooperating front faces and that no appreciable amount of said liquid will remain in contact with the insulating bodies when the two connector elements are coupled together. Such a result is easily obtained if the two insulating bodies are held in abutment against each other by their front faces under the action of an abutting force.

Preferably, in an interesting embodiment because of its simplicity of design and handling, the means controlling the axial movement of the mobile ring are formed by a locking ring carried by the first connector element and providing, in a way known per se, locking of the mechanical coupling of the two connector elements.

In the case where the connector of the invention is intended to be used in a liquid medium under pressure, it is desirable for the ring bearing the annular joints to form an integral part of the case of the first connector element, these means being preferably hydraulic means such as an oil bath subjected to the external pressure and in contact with the insulating body.

Figure 2:
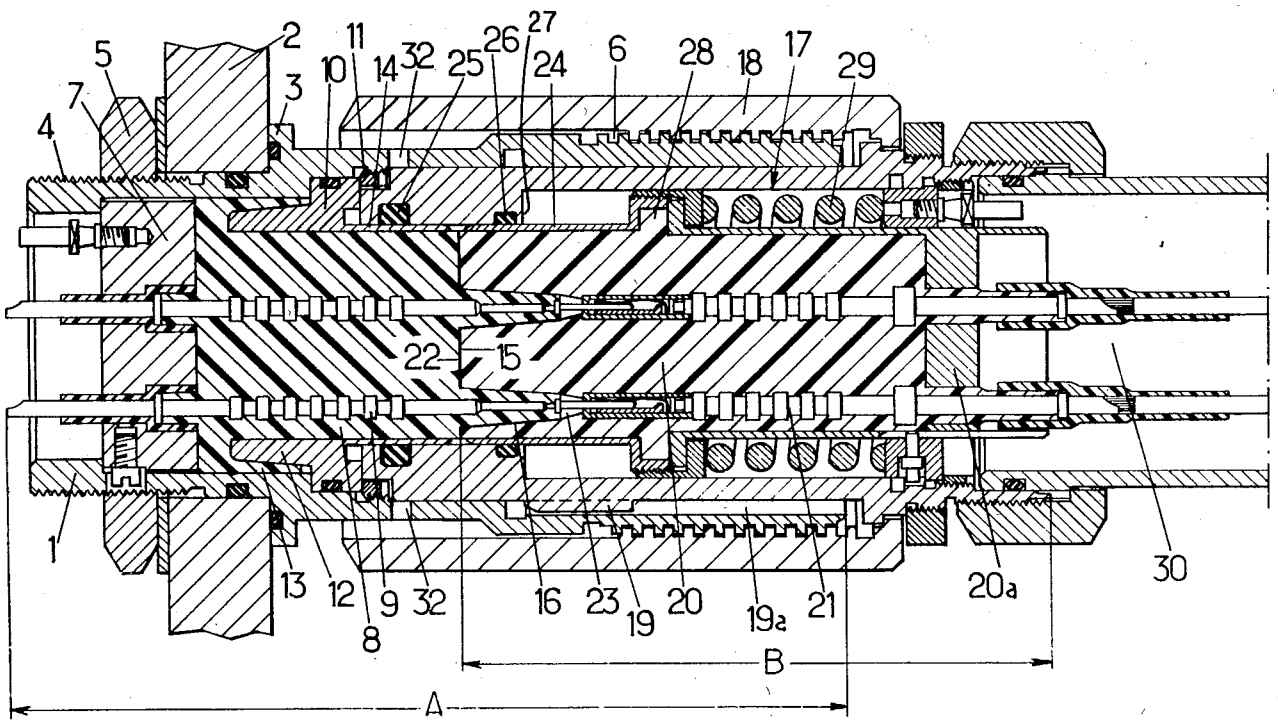

The invention will be better understood from reading the detailed description which follows of a preferred embodiment given solely by way of non limiting example; in the description, reference is made to the accompanying drawings in which FIGS. 1 and 2 are views in axial section of a connector arranged in accordace with the invention, respectively in two different positions (respectively non coupled position and coupled position).

In the following description, by front end or front face (or front) of a connector element will be designated the end or the face of this element adapted for cooperating with the facing end or face of the other connector element, and by rear end or rear face (or rear) the end or the face of said element opposite the preceding one.

With reference first of all to FIG. 1, the connector is formed from a first connector element A, or male element which, in the embodiment shown, may be considered as fixed, and a second connector element B, or female element, which may be considered as movable or mobile.

Element A comprises an external protecting case 1, having a shape cylindrical in revolution, adapted externally in its rear part, for allowing element A to be fixed to a wall 2 (shoulder 3, external thread 4 and locking ring 5) and, in its front part, so as to allow mechanical coupling with element B (thread 6).

On the inside, element A is adapted so as to receive successively (from the rear to the front): an abutment plate 7; an insulating body 8 made from elastomer supporting, in any appropriate way known by a man skilled in the art, male type electric contacts 9 (pins) whose pins for connecting to the electric conductors (not shown) pass through plate 7; a locking ring 10 surrounding an axial part of the insulating body; and finally, a threaded ring 11 screwed inside case 1 and holding the assembly of assembled parts in position by bearing on the bearing surfaces.

Furthermore, it will be noted that seals are provided, on the one hand, between case 1 and wall 2 on which element A is mounted and, on the other hand, between locking ring 10 and case 1. Furthermore, the locking ring 10 has an annular portion 12 offset radially towards the inside whereas the insulating body 8 has an annular skirt 13 which, in the mounting position of the assembly, is compressed between said annular portion 12 and the inner face of case 1.

The locking ring 10 extends forwardly, by an annular zone in the form of a sleeve 14 situated immediately behind the front face 15 of the insulating body 8 and whose role will be explained subsequently.

Finally, the front face 15 of the insulating body 8 has truncated cone shaped bosses 16 surrounding each of the contacts 9, only the pin shaped end of which projects.

Element B also comprises a cylindrical case 17 adapted externally so as to be coupled with the case 1 of element A: for this purpose it is surrounded by a rotary locking ring 18, threaded internally, (for cooperating with the front threaded part of the case 1) and comprises one or more external guide keys 19 for fool proof fitting adapted to slide in grooves **19*a* formed on the inside of case 1**.

Inside case 17 of element B, an insulating body 20, locked rearwardly by a bearing plate **20*a*, carries, in any way known per se, female type electric contacts 21 (sockets). The front parts (sockets) of these contacts do not open directly into the front face 22 of the insulating body 20 but at the bottom of trucated cone shaped recesses 23 in the form of funnels which are formed in said front face 22 and which have a shape complementary to that of the bosses 16 of the insulating body 8** of element A.

A sleeve 24 surrounds the front axial part of the insulating body 20 immediately behind its front face. This sleeve 24 is surrounded by two O sleeves 25, 26, spaced axially apart from each other and housed in grooves formed in the inner surface of case 17. In addition, on the internal face of case 17 there is a shoulder 27 situated behind seal 26 whereas the outer surface of the insulating body 20 has an annular projection 28 forming, towards the front, a shoulder adapted for cooperating with the shoulder 27. A spiral spring 29 surrounds the insulating body 20 behind the annular projection 28 and is compressed between said projection at the front and a fixed supporting surface integral with case 17 at the rear.

When the connector which has just been described is intended to be used in a liquid medium under pressure, for example in an under sea medium, means are provided, at the rear end of element B, for compensating the pressure that the liquid medium exerts on the component parts of the element, and in particular on the front face of the insulating body. This compensation means may for example, in a way known per se, be an oil bath, subjected to the external pressure, filling the space 30 situated at the rear of the insulating body 20 and through which pass the pins of contact 20 and the conductors which are connected thereto.

Finally, it will be noted that there is provided, for each element A and B, a closure cap (not shown) which is positioned on the front of the element and which is adapted so as to present the same configuration as the complementary element so that, when elements A and/or B are immersed in an uncoupled position for a relatively long period of time, the insulating bodies 8 and/or 20 are not left in contact with the ambient liquid.

The operation of the connector of the invention is as follows.

With elements A and B uncoupled they are presented, equipped with their protecting cap, face to face in the suitable angular position determined by the keys 19 and the corresponding grooves **19*a***.

After removal of the protecting caps, the two elements are fitted one into the other and the locking ring 18 of element b is rotated so as to screw it onto the case 1 of element A. The result is an axial rectilinear movement of element B in the direction of element A, during which space 31, filled with liquid, defined by the facing walls of elements A and B reduces in volume, the liquid driven out leaving by the clearances existing between the members (more especially between ring 18 and cases 1 and 17) and possibly through discharge holes 32 provided in the wall of case 1 in front of the insulating body 8.

During this movement, the truncated cone shaped studs 16 surrounding the male contacts 9 penetrate into the truncated cone shaped recesses 33 preceding the female contacts 21 (FIG. 1) while progressively driving out the liquid which is situated therein, and they completely occupy these recesses at the time when the front faces 15 and 22 of the two insulating bodies 8 and 20, respectively, are in abutment against each other (see FIG. 2).

With the insulating body 20 of element B now fixed with respect to element A, case 17 of element B is disengaged from the insulating body 20 and continues its travel alone, under the driving action of ring 18, so as to reach the coupling position shown in FIG. 2.

In this position, the annular seal 25 sealingly surrounds the sleeve 14 of the insulating body 8 of element A, whereas the annular seal 26 sealingly surrounds the sleeve 24 of the insulating body 20 of element B. Thus, the interface 15–22 of the two abutting insulating bodies 8 and 20 is sealingly insulated from the pressurized liquid in which the connector is plunged.

Since moreover, the practically complementary shape of the front faces 15 and 22 and the mutual resilient abutment of the two insulating bodies under the force exerted by the pressurized spring 29 have caused practically complete elimination of the liquid at the level of interface 15/22, no appreciable amount of liquid remains, in the coupling position, in contact with the insulating bodies and thus the risk of an electric insulating defect between contacts is avoided which prior connectors could present in the long run.

Further, in the disconnected position of the connector, the surrounding pressurized liquid exerts a lateral compression on the insulating body 20 of element B (arrows 33), on the one hand, and on the insulating body 8 (arrows 34) and the truncated cone shaped studs 16 (arrows 35) of element A, on the other hand. This compression applies the elastomer forming the insulating bodies against contacts 9 and 21 and is added to the elastic nipping of the elastomer on these contacts due to the shrinkage undergone by the elastomer during polymerization thereof during manufacture of the insulating body. Thus a sealed connection is obtained between the elastomer and the contacts, and the pressurized liquid cannot rise up along the contacts and come into the rear zone of elements A and B.

As is evident and as it follows moreover already from what has gone before, the invention is in no wise limited to those of its modes of application and embodiments which have been more especially cnsidered; it embraces, on the contrary, all variations thereof.

We claim:

1. An electrical connector, particularly intended to be used in a liquid medium over a long time period, comprising first and second connector elements adapted to be removably coupled together within the liquid medium in a first, connected position thereof;

said first connector element including a plurality of male electrical contacts which are supported in a corresponding insulating body and which are partially surrounded with truncated cone shaped bosses projecting a substantial distance outwardly from the front face of the corresponding insulating body;

said second connector element including a like plurality female electrical contacts which are supported in a corresponding insulating body and which open at the bottom of a like plurality of truncated cone shaped recesses formed in the front face of the corresponding insulating body;

resilient means provided in at least one connector element and disposed in relationship with respect to the corresponding insulating body of that connector element so as to continuously push the corresponding insulating body forward;

first and second cylindrical rigid sleeves respectively provided around at least the front parts of said insulating bodies of said first and second connectors, said sleeves having substantially the same transverse dimensions and being so axially positioned that, in the connection position of the two connector elements, the sleeves are in substantially end to end relationship;

one of said connector elements including a ring disposed so as to surround the corresponding sleeve of that connector element and being axially movable under control of a control means, said ring including two internal annular seals and said seals being spaced axially apart from each other by such a distance that, and the axial travel of said ring being such that, when the connector elements are not coupled together and thus the insulating body of the connector element including the ring is retracted into that connector element, both said annular seals surround only the corresponding sleeve of that connector element whereas, when the two connector elements are coupled together and thus the insulating body of the connector member including the ring is in the connection position, said ring overlaps the front parts of the sleeves of both connector elements and the two annular seals surround respective ones of the two sleeves on each side of the interface between the

2. The electric connector according to claim 1, characterized in that means for controlling the axial movement of the movable ring comprises a locking ring carried by the second connector element and providing locking of the mechanical coupling between the two connector elements.

3. The electric connector according to claim 1, characterized in that the ring including the annular seals forms an integral part of a case of the second connector element.

4. The electric connector according to claim 1, intended to be used in a liquid medium under pressure, characterized in that a rear case of the first connector element includes axial pressure compensating means.

5. The electric connector according to claim 4, characterized in that the axial pressure compensating means comprises hydraulic means.

* * * * *